US005842529A

United States Patent [19]

Dietzen

[11] Patent Number: 5,842,529

[45] Date of Patent: Dec. 1, 1998

[54] OIL AND GAS WELL CUTTINGS DISPOSAL SYSTEM

[76] Inventor: Gary H. Dietzen, 110 Stonewood Cir., Lafayette, La. 70508

[21] Appl. No.: 729,872

[22] Filed: Oct. 15, 1996

Related U.S. Application Data

[63] Continuation-in-part of Ser. No. 416,181, Apr. 4, 1995, Pat. No. 5,564,509, which is a continuation-in-part of Ser. No. 197,727, Feb. 17, 1994, Pat. No. 5,402,857.

[51] Int. Cl.[6] ..... E21B 21/06; B09B 5/00

[52] U.S. Cl. ..... 175/66; 175/206; 175/207

[58] Field of Search ..... 175/66, 206, 207; 405/128; 134/108

[56] References Cited

U.S. PATENT DOCUMENTS

| | | | |
|---|---|---|---|
| D. 296,027 | 5/1988 | Dietzen | D34/39 |
| D. 337,809 | 7/1993 | Dietzen | D23/202 |
| 1,125,413 | 1/1915 | Van Doren . | |
| 2,803,501 | 8/1957 | Kelly | 302/17 |
| 3,400,819 | 9/1968 | Burdyn | 175/66 |
| 3,433,312 | 3/1969 | Burdyn et al. | 175/66 |
| 3,993,359 | 11/1976 | Sweeney | 302/15 |
| 4,019,641 | 4/1977 | Merz | 214/14 |
| 4,030,558 | 6/1977 | Morris | 175/206 X |
| 4,595,422 | 6/1986 | Hill et al. | 175/206 X |
| 4,793,423 | 12/1988 | Knol | 175/66 |
| 4,878,576 | 11/1989 | Dietzen | 198/494 |
| 4,942,929 | 7/1990 | Malachosky et al. | 175/66 |
| 5,016,717 | 5/1991 | Simons et al. | 175/66 |
| 5,109,933 | 5/1992 | Jackson | 175/66 |
| 5,190,085 | 3/1993 | Dietzen | 141/98 |
| 5,322,393 | 6/1994 | Lundquist | 406/38 |
| 5,341,856 | 8/1994 | Appenzeller | 141/67 |
| 5,344,750 | 9/1994 | McLachlan et al. | 175/66 |

FOREIGN PATENT DOCUMENTS

| | | |
|---|---|---|
| 0 005 273 | 5/1979 | European Pat. Off. . |
| 2162880 | 2/1986 | United Kingdom . |

OTHER PUBLICATIONS

Max–Vac Rentals, *Vacuum Skid Unit*, SPEC Sheet (With Pictures on Back).

Dresser Industries, Inc., Specifications — *Roots Vacuum Boosters* (Frames 406DVJ thru 1220DVJ), Feb. 1988.

Dresser Industries, Inc., *Roots DVJ Dry Vacuum Whispair® Blowers*, Nov. 1991.

Dresser Industries, Inc., Specifications — *Roots DVJ Whispair® Dry Vaccum Pumps* (Frames 1016J, 1220J and Larger), Dec. 1992.

Chicago Conveyor Corporation, *Pneumatic Conveying Systems and Specialties*, Brochure.

*Primary Examiner*—Frank Tsay

*Attorney, Agent, or Firm*—Garvey, Smith, Nehrbass & Doody, L.L.C.

[57] ABSTRACT

A method of removing drill cuttings from an oil and gas well drilling platform includes the steps of separating the drill cuttings from the well drilling fluid on the drilling platform so that the drilling fluids can be recycled into the well bore during drilling operations. The cuttings are transmitted via gravity flow to a materials trough having an interior defined by sidewalls and a bottom portion. The drill cuttings are suctioned from the bottom portion of the trough interior with a first suction line having an intake portion that is positioned at the materials trough bottom. Drill cuttings are transmitted via the suction line at flow velocities in excess of 100 feet per second to a tank that has two collection chambers. A vacuum is formed in sequence within the interior of each chamber using a blower that is in fluid communication with the tank interior via a second vacuum line. In one embodiment a valve apparatus (preferably timer controlled) directs drill cuttings to one chamber until full and then to another chamber. As each chamber is filled, the cuttings are squeezed with a hydraulic ram to separate drilling fluid from the cuttings and then force the cuttings from the chamber via a lowermost check valve.

43 Claims, 5 Drawing Sheets

OIL AND GAS WELL CUTTINGS DISPOSAL SYSTEM

CROSS REFERENCE TO RELATED APPLICATIONS

This is a continuation-in-part of U.S. patent application Ser. No. 08/416,181, filed Apr. 4, 1995 (now U.S. Pat. No. 5,564,509) which is a continuation-in-part of U.S. patent application Ser. No. 08/197,727, filed Feb. 17, 1994, now U.S. Pat. No. 5,402,857, each of which is incorporated herein by reference.

BACKGROUND OF THE INVENTION

1. Field of the Invention

The present invention relates to the disposal of oil and gas well cuttings such as are generated during the drilling of an oil and gas well using a drill bit connected to an elongated drill string that is comprised of a number of pipe sections connected together, wherein a fluid drilling mud carries well cuttings from the drill bit through a well annulus and to a solids removal area at the well head for separating well cuttings from the drilling mud. Even more particularly, the present invention relates to an improved well cuttings disposal system that collects oil and gas well cuttings in a transportable tank that is subjected to a vacuum and which two chambers alternatively and sequentially receive cuttings and separate drilling mud from the cuttings fro recycling.

2. General Background

In the drilling of oil and gas wells, a drill bit is used to dig many thousands of feet into the earth's crust. Oil rigs typically employ a derrick that extends above the well drilling platform and which can support joint after joint of drill pipe connected end to end during the drilling operation. As the drill bit is pushed farther and farther into the earth, additional pipe joints are added to the ever lengthening "string" or "drill string". The drill pipe or drill string thus comprises a plurality of joints of pipe, each of which has an internal, longitudinally extending bore for carrying fluid drilling mud from the well drilling platform through the drill string and to a drill bit supported at the lower or distal end of the drill string.

Drilling mud lubricates the drill bit and carries away well cuttings generated by the drill bit as it digs deeper. The cuttings are carried in a return flow stream of drilling mud through the well annulus and back to the well drilling platform at the earth's surface. When the drilling mud reaches the surface, it is contaminated with these small pieces of shale and rock which are known in the industry as well cuttings or drill cuttings.

Well cuttings have in the past been separated from the reusable drilling mud with commercially available separators that are know as "shale shakers". Some shale shakers are designed to filter coarse material from the drilling mud while other shale shakers are designed to remove finer particles from the well drilling mud. After separating well cuttings therefrom, the drilling mud is returned to a mud pit where it can be supplemented and/or treated prior to transmission back into the well bore via the drill string and to the drill bit to repeat the process.

The disposal of shale and cuttings is a complex environmental problem. Drill cuttings contain not only the mud product which would contaminate the surrounding environment, but also can contain oil that is particularly hazardous to the environment, especially when drilling in a marine environment.

In the Gulf of Mexico for example, there are hundreds of drilling platforms that drill for oil and gas by drilling into the subsea floor. These drilling platforms can be in many hundreds of feet of water. In such a marine environment, the water is typically crystal clear and filled with marine life that cannot tolerate the disposal of drill cuttings waste such as that containing a combination of shale, drilling mud, oil, and the like. Therefore, there is a need for a simple, yet workable solution to the problem of disposing of oil and gas well cuttings in an offshore marine environment and in other fragile environments where oil and gas well drilling occurs.

Traditional methods of cuttings disposal have been dumping, bucket transport, cumbersome conveyor belts, and washing techniques that require large amounts of water. Adding water creates additional problems of added volume and bulk, messiness, and transport problems. Installing conveyors requires major modification to the rig area and involves many installation hours and very high cost.

SUMMARY OF THE INVENTION

The present invention provides an improved method and apparatus for removing drill cuttings from an oil and gas well drilling platform that uses a drill bit supported with an elongated, hollow drill string. Well drilling fluid (typically referred to as drilling mud) that travels through the drill string to the drill bit during a digging of a well bore. The method first includes the step of separating well drilling fluid from the waste drill cuttings on the drilling platform so that the drilling fluid can be recycled into the well bore during drilling operations. The drill cuttings fall via gravity from solid separators (e.g. shale shakers) into a material trough. At the material trough, cuttings are suctioned with an elongated suction line having an intake portion positioned in the materials trough to intake well cuttings as they accumulate.

The drill cuttings are transmitted via the suction line to a holding tank that has an access opening. A vacuum is formed within the holding tank interior using a blower that is in fluid communication with the tank interior via a second vacuum line.

Liquids (drilling mud residue) and solids (well cuttings) are separated from the vacuum line at the tank before the liquids and solids can enter the blower.

The blower is powered with an electric motor drive, to reach a vacuum of between about sixteen and twenty-five inches of mercury. The vacuum line is sized to generate speeds of between about one hundred and three hundred feet per second.

The tank is sealed after the interior is filled with drill cuttings to be disposed of. The tank is emptied of drill cuttings at a desired remote disposal site by opening the access opening to allow gravity flow of the cuttings from the tank interior via the access opening.

In the preferred embodiment, three suction lines are used including a first line that communicates between the materials trough and the holding tank, a second suction line that extends between the holding tank and a separator skid, and a third suction line that communicates between the separator skid and blower.

The present invention provides alternate embodiments including an alternate embodiment, a second alternate embodiment, and a third alternate embodiment.

In the alternate embodiment, a screw conveyor and associate trough are used for continuously discharging cuttings via a shute from a collection trough to the tank.

In a second alternate embodiment, a slurry unit that has pumps within pillars continuously break up cuttings until they form a slurry with a liquid such as water so that the cuttings can be disposed of by deep well disposal at the drill site rather than transporting the cuttings to a remote site such as onshore in the case of a marine base platform.

A third alternate embodiment features a drill cuttings squeezer that is used in conjunction with the vacuum system of the preferred embodiment. In the third alternate embodiment, instead of material being vacuumed directly into a cuttings tank, the drill cuttings are vacuumed into the squeezer unit which then squeezes out excess drilling fluid from the cuttings prior to being dumped into a tank via rubber check valves.

With the third alternate embodiment, material would be suctioned from a cutting trough via a flow line and into the squeezer unit. In the third alternate embodiment, there are two spaced apart collection chambers and a wye inlet flow line with two valves placed immediately upstream of that pair of cylinders. Material being suctioned by the vacuum system is directed into one chamber or the other sequentially. This allows material to be continuously suctioned without having to shut the operation down.

Valves and hydraulic rams are set on automatic timers for example, so that when one chamber is full, the valves would direct material to the other chamber.

After the material (drill cuttings and drilling mud) is directed to the empty chamber a hydraulic ram in the full collection chamber pushes material downward and out the discharge end. As material is pushed down in the collection chamber, it is compacted and excess fluids squeezed through a screen which is positioned on the side wall of the chamber.

Fluids (i.e. drilling mud) which passes in this manner through the screen (which will have various mesh sizes depending on the particular application) would drain into a hermetically sealed tank in between the two collection chambers.

Fluid would drain into the sump and be pumped off via a diaphragm pump package for example which would transfer the fluid back to the active drilling fluid system of the drilling rig for recycling.

Once the hydraulic ram of a particular collection chamber had pushed all material out of that collection chamber, the hydraulic ram would then return to its position at the top of the collection chamber to await the redirecting of material and cuttings into the chamber using the vacuum system.

This hydraulic squeezer apparatus used in conjunction with the preferred embodiment vacuum system would save expensive drilling fluid that is typically lost along with drill cuttings in traditional solids control equipment found on drilling rigs in the prior art.

The system of the present invention would be automated so that it would continuously operate without having to shut down or continuously monitor and maintain the apparatus.

The apparatus of the present invention would thus work in conjunction with the preferred embodiment of the cuttings vacuums systems so that there would be no need to install augers or conveyors to get material to the squeezer unit.

The system of the present invention will thus help reduce the amount of material to be disposed of by recycling drilling fluids instead of sending those to a disposable site for subsequent disposal.

BRIEF DESCRIPTION OF THE DRAWINGS

For a further understanding of the nature and objects of the present invention, reference should be had to the following detailed description, taken in conjunction with the accompanying drawings, in which like parts are given like reference numerals, and wherein.

DETAILED DESCRIPTION OF THE PREFERRED EMBODIMENT

Figure 1:
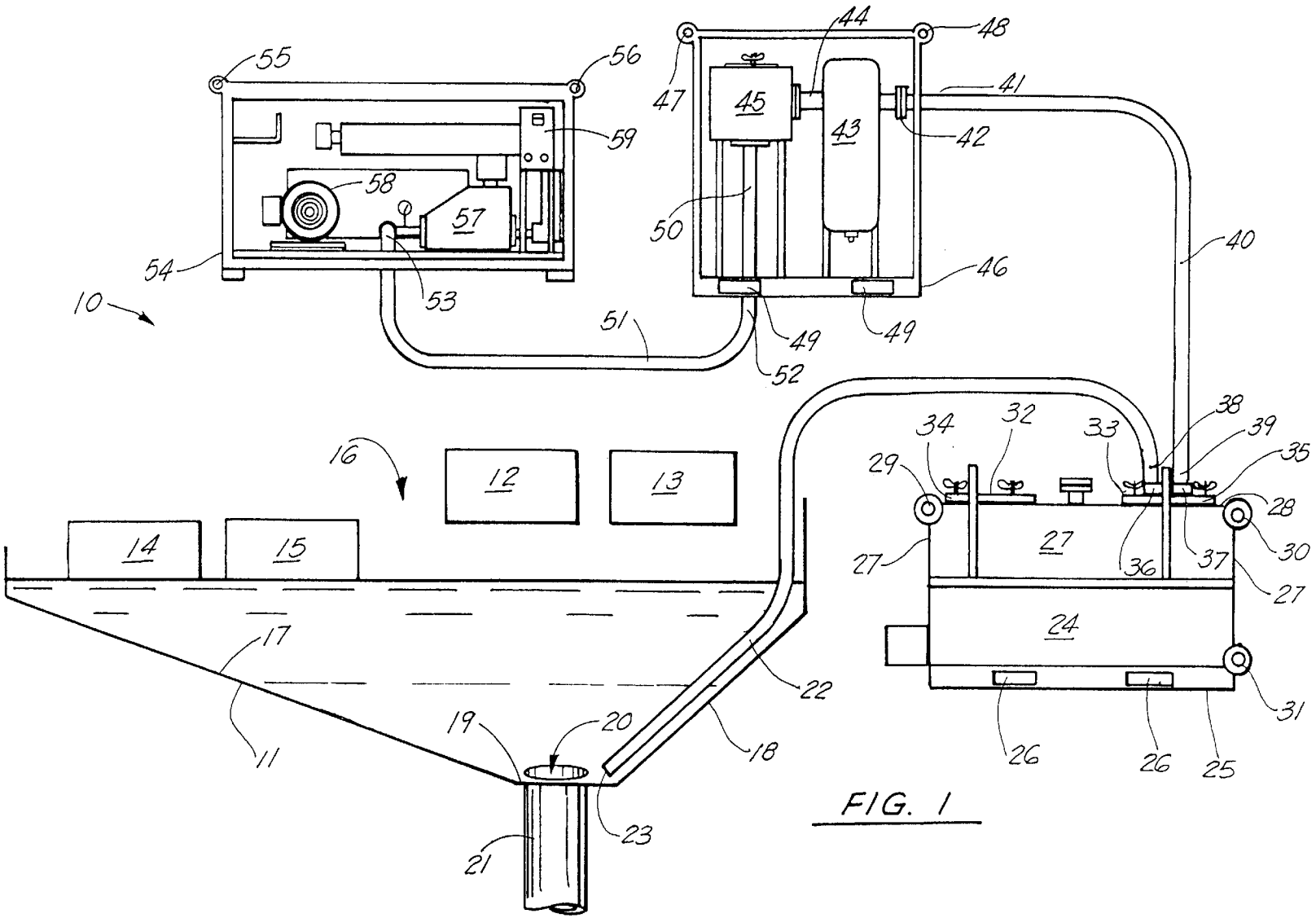
FIG. 1 is a schematic view of the preferred embodiment of the apparatus of the present invention.

In FIG. 1, there can be seen a well cuttings disposal system 10 of the present invention. Well cuttings disposal system 10 is used in combination with a material trough that collects solids falling via gravity from a plurality of solids separator units. Material troughs per se are known in the art, typically as a catch basin for cuttings. The material trough 11 defines an area that is a receptacle for solids containing some residual drilling mud. Cuttings have been collected from the well bore after the drilling mud has been transmitted through the drill string to the drill bit and then back to the surface via the well annulus.

At the material trough, there are a plurality of coarse shakers 12, 13 and a plurality of fine shakers 14, 15. The shakers 12, 13, and 14, 15 are commercially available. Coarse shakers 12, 13 are manufactured under and sold under the mark "BRANDT" and fine shakers are sold under the mark "DERRICK". Shakers 12–15 channel away the desirable drilling mud to a mud pit. The well cuttings fall via gravity into trough 11. It is known in the prior art to channel away drilling mud that is to be recycled, and to allow well cuttings to fall from shale shakers via gravity into a receptacle. Such as been the case on oil and gas well drilling rigs for many years.

Interior 16 of trough 11 catches cuttings that have fallen from shakers 12, 15. The trough 11 thus defines an interior 16 having a plurality of inclined walls 17, 18 that communicate with a trough bottom 19. Walls 17, 18 can be Teflon covered to enhance travel of material to bottom 19.

Trough bottom 19 includes a discharge opening 20 that communicates with discharge conduit 21. The opening 20 is typically sealed during operation with a closure plate (not shown).

A first suction line 22 is positioned to communicate with the interior 16 portion of trough 11. First suction line 22 thus provides an inlet 23 end portion and an opposite end portion that communicates with collection tank 24. Tank 24 collects solid material and some liquid (eg. residual drilling mud on the cuttings) as will be described more fully hereinafter.

Collection tank 24 has a bottom 25, a plurality of four generally rectangular side walls 27, and a generally rectangular top 28. A pair of spaced apart fork lift sockets 26 allow tank 24 to be lifted and transported about the rig floor and to a position adjacent a crane or other lifting device.

A plurality of lifting eyes 29, 31 are provided including eyes 29, 30 on the top of tank 24 and lifting eye 31 on the side thereof near bottom 25.

The lifting eyes 29 and 30 are horizontally positioned at end portions of the tank top 28. This allows the tank to be lifted with a crane, spreader bar, or other lifting means for transferral between a marine vessel such as a work boat and the drilling rig platform. In FIG. 1, the tank 24 is in such a generally horizontal position that is the orientation during use and during transfer between the rig platform and a remote location on shore, for example.

The lifting eyes 30, 31 are used for emptying the tank 24 after it is filled with cuttings to be disposed of. When the tank is to be emptied, a spreader bar and a plurality of lifting lines are used for attachment to lifting eyes 30, 31. This supports the tank in a position that places lifting eye 29 and lifting eye 30 in a vertical line. In this position, the hatch 34 is removed so that the cuttings can be discharged via gravity flow from opening 30 and into a disposal site.

During a suctioning of well cuttings from materials trough 11, the suction line 22 intakes cuttings at inlet 23. These cuttings travel via line 22 to outlet 38 which communicates with coupling 36 of tank 24. Flow takes place from inlet 23 to outlet 38 because a vacuum is formed within the hollow interior of tank 24 after hatches 34, 35 are sealed. The vacuum is produced by using second suction line 40 that communicates via separators 43, 45 with third suction line 51 and blower 57.

Second suction line 41 connects at discharge 39 to coupling 37 of hatch 35. The opposite end of suction line 40 connects at end portion 41 via coupling 42 to fine separator 43. A second fines separator 45 is connected to separator 43 at spool piece 44. The two separators 43 and 45 are housed on a structural separator skid 46 that includes lifting eyes 47, 48 and fork lift sockets 49 for transporting the skid 46 in a manner similar to the transport of tank 24 as aforedescribed.

Third suction line 51 connects to effluent line 50 that is the discharge line from separator 45. End portion 52 of third suction line 51 connects to effluent line 50 at a flanged, removable connection for example. The three suction lines 22, 40, 51 are preferably between three and six inches in internal diameter, and are coupled with blower 57 generating about 300–1500 CFM of air flow, to generate flow desired velocities of about 100–300 feet per second that desirably move the shale cuttings through suction line 22. The suction lines are preferably flexible hoses of oil resistant PVC or can be Teflon coated rubber. Quick connect fittings are used to connect each suction line at its ends.

End portion 53 of third section line 51 also connects via a flanged coupling, for example, to blower 57. Blower 57 and its motor drive 58 are contained on power skid 54. Power skid 54 also includes a control box 59 for activating and deactivating the motor drive 58 and blower 57. The power skid 54 provides a plurality of lifting eyes 55, 56 to allow the power skid 54 to be transported from a work boat or the like to a well drilling platform using a lifting harness and crane that are typically found on such rigs.

Each of the units including tank 24, separator skid 46, and power skid 54 can be lifted from a work boat or the like using a crane and transported to the rig platform deck which can be for example 100 feet above the water surface in a marine environment.

Figure 2:
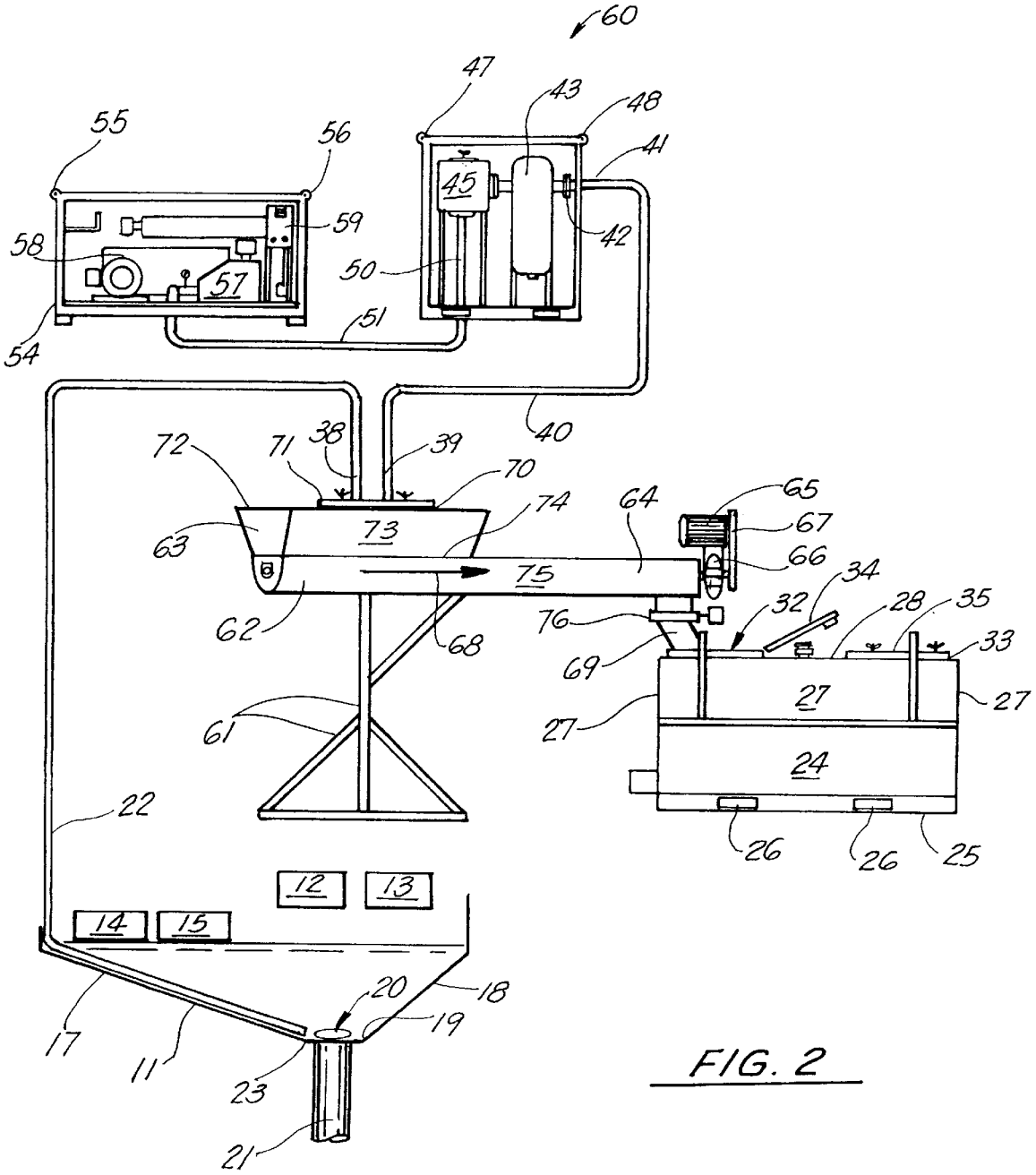
FIG. 2 is a schematic view of an alternate embodiment of the apparatus of the present invention.

In FIG. 2, an alternate embodiment of the apparatus of the present invention is disclosed designated generally by the numeral 60. In FIG. 2, the tank 24 is similarly constructed to that of the preferred embodiment of FIG. 1. However, in FIG. 2, the well cuttings disposal system 60 includes a support 61 that supports a screw conveyor 62 and its associated trough 63. The trough 63 and screw conveyor 62 are sealed at opening 70 in trough 63 using hatch 71. Trough 63 is positioned at an intake end portion of screw conveyor while the opposite end portion of screw conveyor 62 provides a discharged end portion 64 that communicates with discharge shoot 69. Chute 69 empties into opening 32 when hatch 34 is open during use, as shown in FIG. 2.

The screw conveyor 62 is driven by motor drive 65 that can include a reduction gear box 66 for example, and a drive belt 67. Arrow 68 in FIG. 2 shows the flow path of coarse cuttings that are discharged via first suction lines 22 into opening 70 and trough 63. The sidewall and bottom 74 of trough 63 communicate and form a seal with screw conveyor outer wall 75 so that when a vacuum is applied using second suction line 40, cuttings can be suctioned from trough 11 at intake 23 as with the preferred embodiment. The conveyor 62 forcibly pushes the drill cuttings toward discharge end 64. A spring activated door 76 is placed in chute 69. When material backs up above door 76, the door quickly opens under the weight of cuttings in chute 69. Once the cuttings pass door 76, the door shuts to maintain the vacuum inside trough 73, and screw conveyor 62, thus enabling continuous vacuuming.

Figure 3:
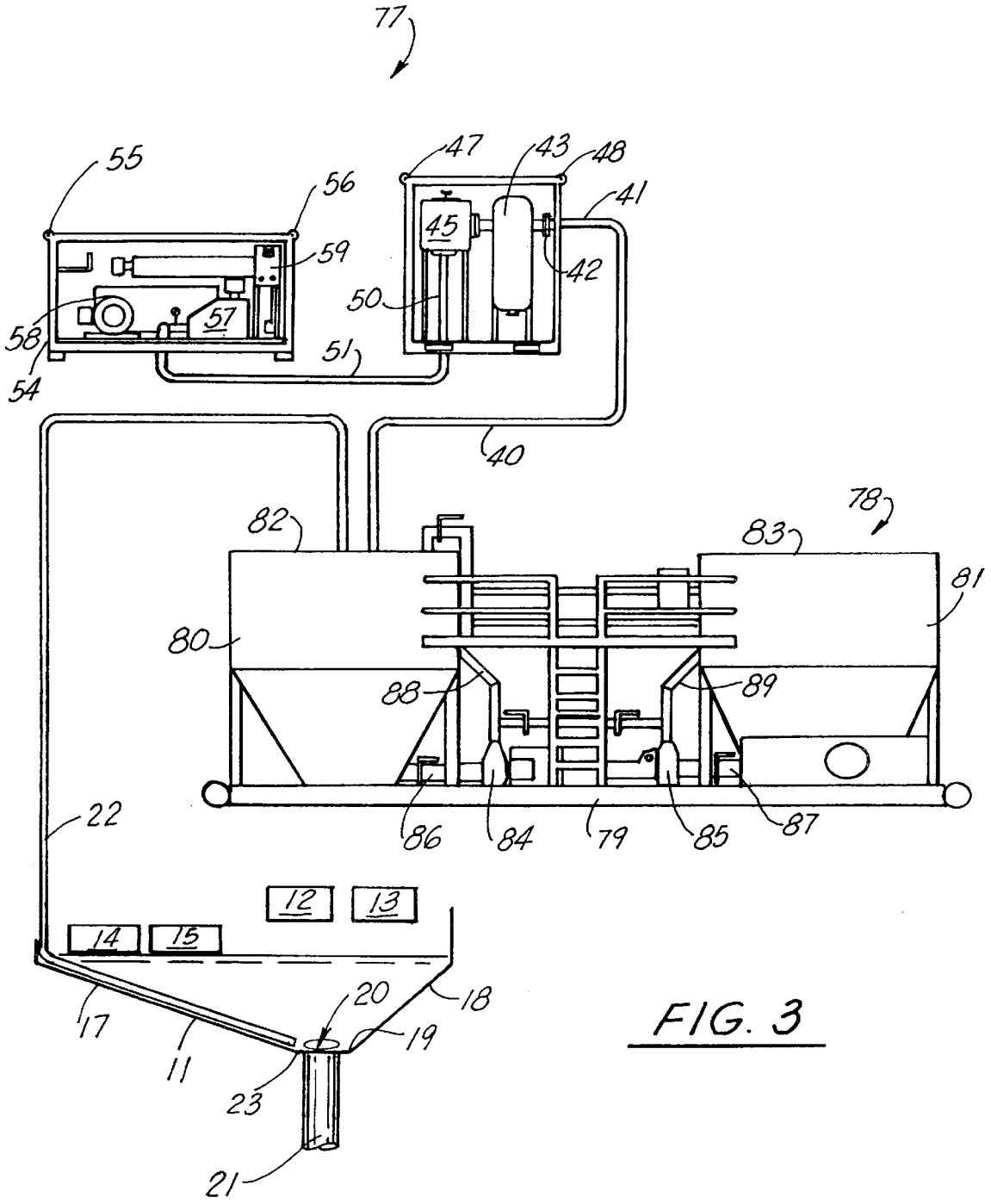
FIG. 3 is a schematic view of a second alternate embodiment of the apparatus of the present invention.

In FIG. 3 there can be seen a second alternate embodiment of the apparatus of the present invention designated generally by the numeral 77. Well disposal cutting system 77 substitutes a slurry unit 78 for collection tank 24 of FIG. 1. Slurry unit 78 has a liftable base frame 79 of welded steel, for example. Upon the frame 79 are positioned a pair of spaced apart vessels 80, 81. Each vessel 80, 81 has a top into which well cuttings can be suctioned in a manner similar to the way in which well cuttings are suctioned into collection tank 24 with the embodiment of FIG. 1. The vessel tops 82, 83 respectively can be provided with openings for connecting the flow lines 22–40 thereto as with the embodiments of FIGS. 1 and 2. The slurry unit 28 provides pumps with impellers (e.g., Mission Magnum fluid centrifugal pump with 75 hp electric motor—5" discharge, 6" suction) for breaking up the cuttings continuously until they form a slurry with a liquid such as water, for example. Pumps 84, 85 have suctioned flow lines 86, 87 respectively and discharge lines 88, 89 respectively. The discharge lines 88, 89 can be seen communicating with the upper end portion of each of the vessels 80, 81 respectively. Likewise, the suction lines 86, 87 communicate with the lower end portion of each of the vessels 80, 81 respectively.

Using the method and apparatus of FIG. 3, a desired volume of cuttings can be suctioned into either one or both of the vessels 80, 81. The pumps 84, 85 are equipped with impellers that can chop up the cuttings into even finer pieces. For example, the pump impellers can have carbide tips that are effective in chopping up and pulverizing the cuttings until a slurry is formed. Each pump 84, 85 respectively continuously recirculates the slurry of cuttings and water between the pump 84, 85 and its respective vessel 80, 81 until a thick viscous slurry is created. A triplex pump (e.g., Gardner Denver) and piping (not shown) can then be used for transmitting the slurried cuttings from the respective vessels 80, 81 downhole, into the well annulus, usually between 2000'–5000' for example, into a porous zone such as a sand zone. In this fashion, the cuttings are disposed of by deep well disposal at the drill site rather than transporting the cuttings to a remote cite such as onshore in the case of a marine based platform.

Figure 4:
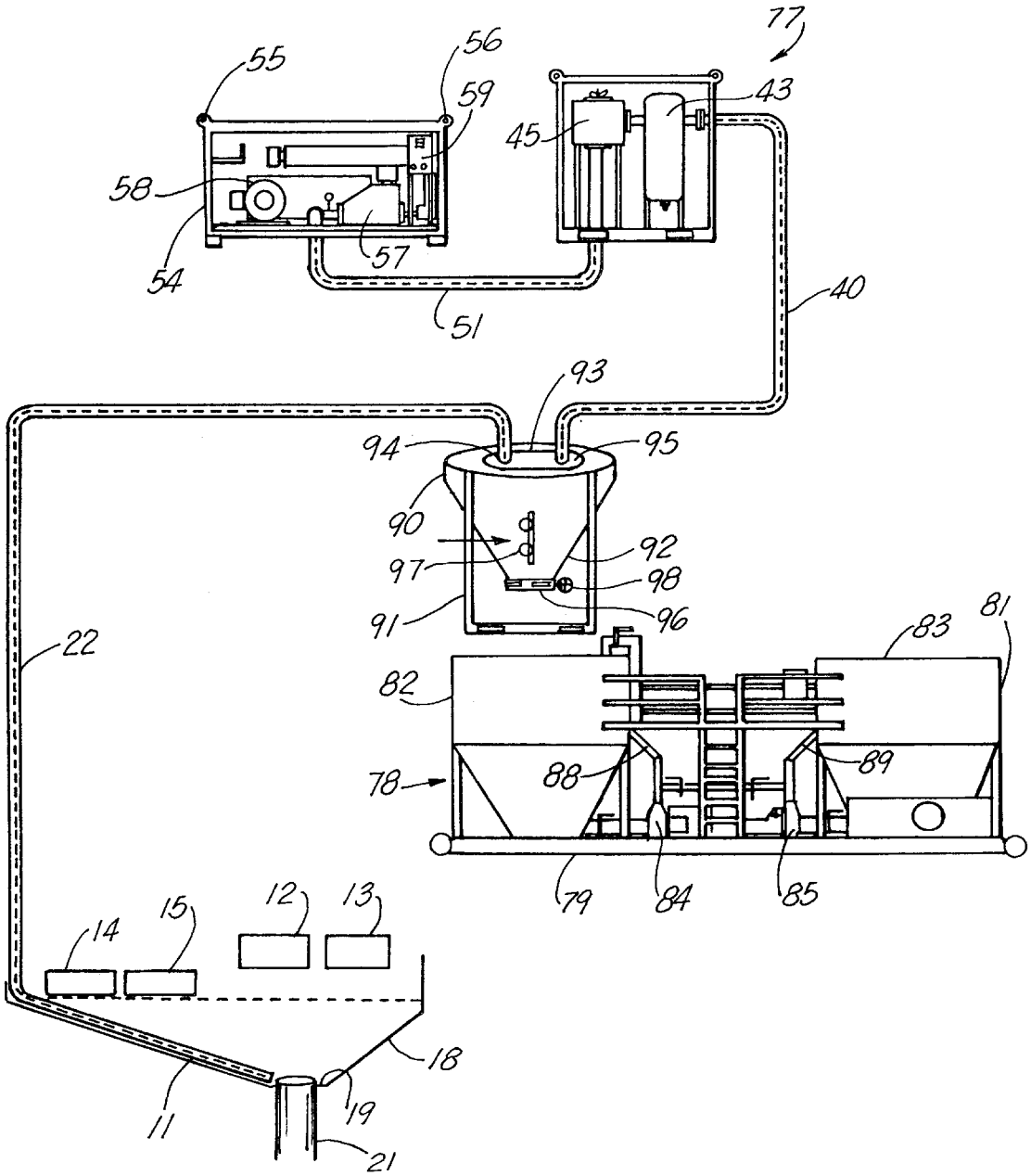
FIG. 4 is a schematic view of the second alternate embodiment of the apparatus of the present invention illustrating the use of a hopper tank in combination with the slurry unit.

In FIG. 4, a hopper tank 90 is shown in combination with the slurry unit 78. Hopper 90 is an optional unit that can be used to receive cuttings from first suction line 22 and to collect the cuttings for batch discharge into slurry unit 78 at intervals. As with the embodiment of FIG. 1, the hopper tank 90 provides a rectangular or circular lid 93 with openings 94, 95 that respectively communicate with vacuum lines 22 and 40.

Hopper tank 90 is preferably supported with a structural liftable frame 91. The tank 90 has a conical wall 92. The upper end portion of tank 90 provides the circular lid 93 while the lower end portion of tank 90 has a discharge outlet 96 controlled by valve 98. Air vibrators 97 can be attached to the conical wall 92 for insuring a complete and smooth discharge of cuttings from within the interior of the hollow hopper tank 90.

Figure 5:
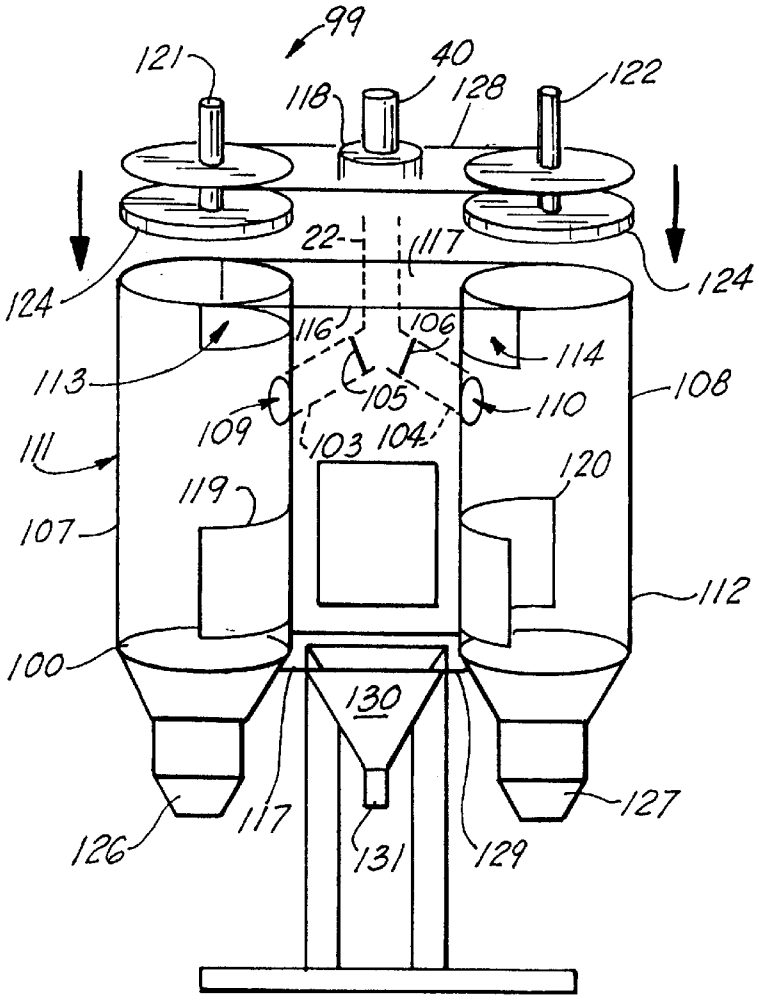
FIG. 5 is an elevational front view of an alternate embodiment of the apparatus of the present invention that utilizes a cuttings squeezer in combination with a vacuum system.
Figure 6:
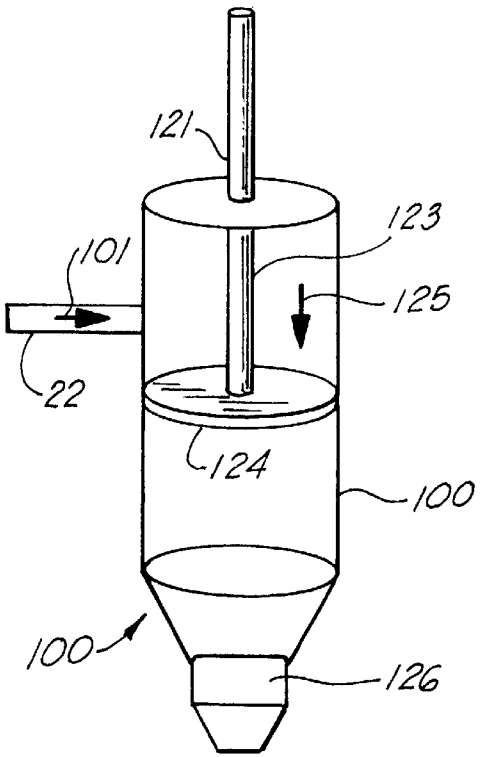
FIG. 6 is a side elevational view of the third alternate embodiment of the apparatus of the present invention.

FIGS. 5 and 6 show a third alternate embodiment of the apparatus of the present invention designated generally by the numeral 99. In the embodiment of FIGS. 5 and 6, the apparatus shown functions in combination with suction components of FIG. 1 or FIG. 2. In the embodiment of FIGS. 5 and 6, the tank 24 of FIG. 1 is replaced with the cuttings squeezer 100 including its collection cylinders 107, 108, liquid hopper 117, and the associated piping.

In this fashion, the suction line 22 of FIG. 1 communicates with an inlet in the form of a wye fitting 102 that carries cuttings from flow line 22 to the wye fitting 102 of FIGS. 5 and 6. The vacuum line 40 of FIGS. 1 and 2 functions as an outlet flowline for suction that communicates with an uppermost outlet fitting 118 on liquid hopper 117.

In the embodiment of FIGS. 5 and 6, the drill cuttings squeezer 100 would thus be used in conjunction with the vacuum system components of FIGS. 1. Instead of material being vacuumed directly into a cutting tank 24 as with FIG. 1 however, material would be suctioned from the cutting trough 11 via flowline 22 to drill cuttings squeezer 100 as shown by arrow 101 in FIG. 5. The vacuum flowline 40 would communicate with outlet fitting 118 of drill cuttings squeezer 100. In the embodiment of FIGS. 5 and 6, the drill cuttings squeezer 100 replaces the tank 24 of FIG. 1.

Wye fitting 102 has a pair of branch lines 103, 104 each of which carries a valve 105, 106. Valves 105, 106 can be for example power operated ball valves such as electrically operated or air operated ball valves.

Each branch line 103, 104 communicates with a collection chamber or cylinder 107, 108 respectively. Openings 109, 110 in the collection chamber 107, 108 respectively allow material to flow via line 22 to wye fitting 102 and then to either branch line 103 or 104 depending upon which of the ball valves 105, 106 is open or closed.

The valves would preferably be set on automatic timers so that once a particular collection chamber 107 or 108 is full, the valves 105, 106 switch positions to direct material to the other chamber that is not full. When a chamber is full, a hydraulic ram associated with each cylinder pushes material downward and out of the discharge end. Each of the collection chambers 108, 109 is comprised of a cylindrically shaped hollow cylinder having outer wall 111, 112 respectively to provide a hollow interior for holding material that is conveyed to the cylinders 107, 108 via the wye fitting 102 and branch lines 103, 104.

At the lower end of each collection cylinder 107, 108 there is provided a screen 119, 120 respectively so that liquid (i.e. drilling fluid) mixed with the drill cuttings can be separated to flow through the screen 119 or 120 into liquid hopper 117. At the upper end of each cylinder 107, 108 a curved air return outlet 113, 114 through the collection cylinder wall 111 or 112 that provides a return line for suction that communicates with outlet fitting 118 and flowline 40.

The liquid hopper 117 thus provides a pair of opposed rectangular plates 115, 116 that can be welded to the wall 111, 112 of the cylinders 107, 108 to form an enclosure in between the cylinders 107, 108. Welded steel plates also seals the hopper 117 at the top and at the bottom. Outlet fitting 118 is an outlet fitting on an upper plate member 128. Likewise, a lower plate 129 carries funnel 130.

At the bottom of the liquid hopper 117, there is provided funnel portion 130 and a liquid outlet 131. In this fashion, liquid can be removed after it has been separated from the cuttings using the hydraulic rams 121, 122 and screen 119, 120 associated with the cylinders 107, 108.

The operation of a single hydraulic ram 121 is shown in FIG. 6. The ram 121 includes a pushrod 123 and a circular plate 124 that fits snugly against the cylindrically shaped wall 111 of collection cylinder 107. As the hydraulic driven ram 121 is operated to force pushrod 123 downwardly in the direction of arrow 125, material below the circular disk 124 is pushed toward the check valve 126. Each of the tanks 107, 108 similarly provides a pushrod 123, circular plate 124, and outlet check valve 126 or 127. The check valve 126, 127 are preferably rubber-like check valves that are commercially available from Red Valve Company for example.

During use, material such as drill cuttings, some drilling mud and the like would be directed into one cylinder 107, 108 or another cylinder 107 or 108 sequentially so that the material could be continuously suctioned via line 22 without having to shut the apparatus down. The valves 105, 106 and hydraulic cylinders 121, 122 would preferably be set on automatic timers so that when a chamber 107 or 108 is full of material, the valves 105, 106 would be either opened or closed to direct material to the other chamber that would be empty. The chambers 107, 108 thus alternate between empty and full condition, one chamber filling is filling while the other is being emptied.

After the material was then directed to the empty chamber, the hydraulic ram 121 or 122 associated with that chamber would begin to push material downward and out of the discharge end via the check valve 126 or 127. As the drill cuttings material and associated drilling fluid is pushed down, it will be compacted and excess fluid squeezed through the screen 119 or 120. Each screen 119 or 120 can be removable and of a selected mesh size depending upon the particular application.

Fluid which passes through a screen 119 or 120 would drain into the hermetically sealed tank 117. Tank 117 is preferably fabricated for example by welding the plates 115 and 116 to opposing sides of the cylinders 107, 108 as shown in FIG. 5 and by similarly welding plates 128, 129 at the top and bottom respectively of the collection cylinders 107, 108 to form an enclosure. In this fashion, the only inlet and outlet on the drill cutting squeezer 100 would be inlet line 22 that communicates with trough 11 and suction outlet line 40 that communicates with separators 43 and 45.

Fluid would drain into the funnel or sump 131 of liquid hopper 117. This collected drilling fluid could then be pumped with a diaphragm pump to transfer the drilling fluid back to the active drilling fluid system of the rig for recycling. Once the hydraulic ram 121 or 122 has pushed material completely out of collection chamber 107 or 108 in the direction of arrow 132, a hydraulic cylinder attached to pushrod 123 would return disk 124 to its upper, starting position at the top of the cylinder 107 or 108 to await the redirecting of material into the cylinder via the branch lines 103, 104 and the openings 109, 110.

The following table lists the parts numbers and parts descriptions as used herein and in the drawings attached hereto.

PARTS LIST

| Part Number | Description |
|---|---|
| 10 | well cuttings disposal system |
| 11 | material trough |
| 12 | coarse shaker |
| 13 | coarse shaker |
| 14 | fine shaker |
| 15 | fine shaker |
| 16 | reservoir |
| 17 | inclined wall |
| 18 | inclined wall |
| 19 | trough bottom |
| 20 | discharge opening |
| 21 | conduit |
| 22 | first suction line |
| 23 | inlet |
| 24 | collection tank |
| 25 | bottom |
| 26 | fork lift socket |
| 27 | side wall |
| 28 | top |
| 29 | lifting eye |
| 30 | lifting eye |
| 31 | lifting eye |
| 32 | opening |
| 33 | opening |
| 34 | hatch |
| 35 | hatch |
| 36 | coupling |
| 37 | coupling |
| 38 | outlet |
| 39 | discharge |
| 40 | second suction line |
| 41 | end |
| 42 | coupling |
| 43 | separator |
| 44 | spool piece |
| 45 | separator |
| 46 | separator skid |
| 47 | lifting eye |
| 48 | lifting eye |
| 49 | fork lift socket |
| 50 | effluent line |
| 51 | third suction line |
| 52 | end |
| 53 | end |
| 54 | power skid |
| 55 | lifting eye |
| 56 | lifting eye |
| 57 | blower |
| 58 | motor drive |
| 59 | control box |
| 60 | well cuttings disposal system |
| 61 | support |
| 62 | screw conveyor |
| 63 | trough |
| 64 | discharge end portion |
| 65 | motor drive |
| 66 | gearbox |
| 67 | drive belt |
| 68 | arrow |
| 69 | discharge chute |
| 70 | opening |
| 71 | hatch |
| 72 | top |
| 73 | side wall |
| 74 | bottom |
| 75 | screw conveyor outer wall |
| 76 | spring loaded door |
| 77 | well cuttings disposal unit |
| 78 | slurry unit |
| 79 | frame |
| 80 | vessel |
| 81 | vessel |
| 82 | top |
| 83 | top |
| 84 | pump |
| 85 | pump |

-continued

PARTS LIST

| Part Number | Description |
|---|---|
| 86 | flow line |
| 87 | flow line |
| 88 | flow line |
| 89 | flow line |
| 90 | hopper tank |
| 91 | liftable frame |
| 92 | conical wall |
| 93 | circular lid |
| 94 | opening |
| 95 | opening |
| 96 | outlet |
| 97 | air vibrator |
| 98 | valve |
| 99 | cutting system |
| 100 | drill cuttings squeezer |
| 101 | arrow |
| 102 | wipe fitting |
| 103 | branch line |
| 104 | branch line |
| 105 | valve |
| 106 | valve |
| 107 | collection cylinder |
| 108 | collection cylinder |
| 109 | inlet opening |
| 110 | inlet |
| 111 | wall |
| 112 | wall |
| 113 | opening |
| 114 | opening |
| 115 | plate |
| 116 | plate |
| 117 | liquid hopper |
| 118 | outlet fitting |
| 119 | screen |
| 120 | screen |
| 121 | ram |
| 122 | ram |
| 123 | pushrod |
| 124 | circular plate |
| 125 | arrow |
| 126 | check valve |
| 127 | check valve |
| 128 | upper plate member |
| 129 | lower plate member |
| 130 | funnel |
| 131 | outlet |
| 132 | arrow |

Because many varying and different embodiments may be made within the scope of the inventive concept herein taught, and because many modifications may be made in the embodiments herein detailed in accordance with the descriptive requirement of the law, it is to be understood that the details herein are to be interpreted as illustrative and not in a limiting sense.

What is claimed as invention is:

1. A method of removing drill cuttings from an oil and gas well drilling platform that uses a drill bit supported with a drill string and a well drilling fluid during a digging of a well bore, comprising the steps of:

a) separating drill cuttings from the well drilling fluid on the drilling platform so that the drilling fluids can be recycled into the well bore during drilling operations;

b) transmitting the separated cuttings to a cuttings receiving area;

c) suctioning the separated drill cuttings with a first suction line having an intake end portion that can be positioned at the cuttings receiving area;

d) transmitting the drill cuttings via the suction line to a first vessel that has an interior, at least one access opening for communicating with the first vessel interior, and a valve that can disallow flow of material from the first vessel when a vacuum is present in the first vessel interior;

e) forming a vacuum within the first vessel interior with a blower that is in fluid communication with the tank interior via a second vacuum line;

f) separating liquids and solids from at least one of the vacuum lines before said liquids and solids can enter the blower; and g) emptying the first vessel of drill cuttings by discharging the cuttings through the valve and into a second vessel.

2. The method of claim 1 wherein in step "d", the tank has two collection tank portions and wherein steps "d", "e" and "f" the collection tank portions are filled and emptied in an alternating sequence.

3. The method of claim 1 wherein the flow velocity in the first suction line is about one hundred to three hundred (100–300) feet per second.

4. The method of claim 1 further comprising the step of separating residual drilling fluid from drill cuttings within the tank.

5. The method of claim 1 wherein in step "f", liquids and solids are separated from the first suction line at the holding tank and liquids and solids are separated from the second suction line at a separator that is positioned in fluid communication with the second vacuum line upstream of the blower.

6. The method of claim 1 wherein in step "g", the blower generates fluid flow in the vacuum lines of between about three hundred and fifteen hundred (300–1500) cubic feet per minute.

7. The method of claim 1 wherein the vacuum formed within the tank in step "e" is between about sixteen and twenty-five (16–25) inches of mercury.

8. An oil well drill cuttings disposal apparatus for removing drill cuttings from a drilling platform that uses a drill bit supported with a drill string and a well drilling fluid comprising:

a) a tank for collecting drill cuttings to be disposed of, said tank having a pair of collection chambers, each with an interior and an inlet opening that allows material to be added to the tank, and outlets that enable a selected chamber to be emptied;

b) a first suction line for transmitting cuttings from the drill site to one of the inlet openings;

c) a power source for forming a vacuum within a selected one of the chambers and comprising a powered blower;

d) a second suction line for communicating between the tank interior and the power source;

e) the tank defining a separator positioned in a suction line for preventing the travel of solid and liquid matter from the tank interior to the blower; and f) each collection chamber having a valve for valving the discharge of drill cuttings from the collection chamber.

9. The apparatus of claim 8 wherein the suction lines are flexible hoses.

10. The apparatus of claim 8 further comprising a valve apparatus for directing well cuttings to one of the collection chambers at a time.

11. The apparatus of claim 8 wherein the valve apparatus continuously directs cuttings one of the chambers so that the first suction line can continuously intake cuttings.

12. The apparatus of claim 8 wherein there is a separator vessel positioned between the power source and the tank in the second suction line that defines a second separator.

13. The apparatus of claim 8 wherein the tank and power source are separate, transportable units.

14. The apparatus of claim 12 wherein the tank and separator vessel are each mounted on separate transportable frames.

15. The apparatus of claim 8 wherein the tank comprising:

a) a pair of separate collection chambers;

b) a closed wall portion that defines a closed vacuum holding chamber for pulling a vacuum on either chamber;

c) a liquid hopper in between the collection chambers;

d) an inlet flowline that can direct cuttings to either collection chamber;

e) a compression member in each chamber for compressing drill cuttings therein; and f) a liquid outlet for receiving liquid that is squeezed from the drill cuttings by the compression member.

16. A method of removing drill cuttings from an oil and gas well drilling platform that uses a drill bit supported with a drill string and a well drilling fluid during a digging of a well bore, comprising the steps of:

a) separating drill cuttings from the well drilling fluid on the drilling platform so that the drilling fluids can be recycled into the well bore during drilling operations;

b) transmitting the cuttings to a cuttings receiving area;

c) suctioning the separated drill cuttings from the cuttings receiving area with a first suction line having an intake end portion that can be positioned at the cuttings receiving area;

d) transmitting the drill cuttings via the suction line to a first vessel that has an interior and an outlet valve;

e) forming a vacuum within the interior of the first vessel with a blower that is in fluid communication with the interior of the first vessel via a second vacuum line;

f) separating liquids and solids from the first and second vacuum lines before said liquids and solids can enter the blower;

g) separating drilling fluid entrained in the drill cuttings within the first vessel; and h) purging the first vessel of drill cuttings through the valve after some drilling fluid is separated from the cuttings in step "g".

17. The method of claim 16 wherein in step "d", the tank has a ram for engaging the cuttings during emptying.

18. The method of claim 16 wherein the flow velocity in the first suction line is about one hundred to three hundred (100–300) feet per second.

19. The method of claim 17 further comprising the step of separating residual drilling fluid from drill cuttings within the tank by compacting the cuttings with the ram.

20. The method of claim 16 wherein in step "f", liquids and solids are separated from the first suction line at the tank and liquids and solids are separated from the second suction line at a separator that is positioned in fluid communication with the second vacuum line upstream of the blower.

21. The method of claim 16 wherein in step "e", the blower generates fluid flow in the vacuum lines of between about three hundred and fifteen hundred (300–1500) cubic feet per minute.

22. The method of claim 16 wherein the vacuum formed within the tank in step "e" is between about sixteen and twenty-seven (16–27) inches of mercury.

23. An oil well drill cuttings disposal apparatus for removing drill cuttings from a drilling platform that uses a drill bit supported with a drill string and a well drilling fluid comprising:

a) a cuttings collection hopper apparatus for collecting drill cuttings to be disposed of at a drill site, said hopper having a collection chamber with an interior;

b) a first suction line for transmitting cuttings from the drill site to the hopper;

c) a blower for forming a vacuum within the hopper;

d) a second suction line for communicating between the hopper and the blower;

e) the hopper defining a separator that is positioned in communication with one of the suction lines for preventing the travel of solid and liquid matter from the hopper to the blower;

f) the hopper having an outlet for discharging drill cuttings from the hopper; and g) a disposal vessel for receiving cuttings that are discharged from the hopper through the outlet.

24. The apparatus of claim 23 wherein the suction lines are flexible hoses.

25. The apparatus of claim 23 wherein there are two hoppers and further comprising a flow control apparatus for directing well cuttings to a selected one of the hoppers at a time.

26. The apparatus of claim 23 further comprising a ram associated with the hopper for pushing cuttings from the hopper during a discharging of cuttings from the hopper.

27. The apparatus of claim 25 further comprising means associated with each hopper for separating liquid from drill cuttings contained within the hopper.

28. The apparatus of claim 26 wherein the hopper is mounted on a transportable frame.

29. The apparatus of claim 23 wherein the disposal vessel is a tank.

30. The apparatus of claim 23 wherein the disposal vessel is a slurry unit.

31. The apparatus of claim 23 wherein the hopper has an inclined sidewall portion.

32. The apparatus of claim 23 wherein the outlet is an outlet valve.

33. The apparatus of claim 31 wherein the hopper has a conically-shaped lower end portion that carries said outlet.

34. A method of removing drill cuttings from an oil and gas well drilling platform that uses a drill bit supported with a drill string and a well drilling fluid during a digging of a well bore, comprising the steps of:

a) separating drill cuttings from the well drilling fluid on the drilling platform so that the drilling fluids can be recycled into the well bore during drilling operations;

b) transmitting the cuttings to a cuttings collection area;

c) suctioning the separated drill cuttings with a suction line having an intake end portion that can be positioned at the cutting collection area;

d) transmitting the drill cuttings via the suction line to a first vessel that has an interior;

e) forming a vacuum within the suction line and first vessel interior in steps "a" through "d" with a blower that is in fluid communication with the first vessel via a second vacuum line;

f) discharging cuttings from the first vessel into a second vessel; and g) preventing liquids and solids that flow through the suction lines from entering the blower.

35. The method of claim 34 wherein in step "h", liquids and solids are prevented from entering the second vacuum line at the first vessel.

36. The method of claim 34 wherein the first vessel is a hopper.

37. The method of claim 34 wherein the first vessel is a cuttings squeezer.

38. The method of claim 35 wherein the first vessel has a ram that enables cuttings to be compacted within the first vessel.

39. The method of claim 35 wherein in step "f" the second vessel is a collection tank.

40. The method of claim 34 wherein in step "f" the second vessel is a slurry unit.

41. The method of claim 34 wherein in step "d" the first vessel is a vessel with a ram that assists in the discharge of cuttings through the outlet and further comprising the step of forcing cuttings through the outlet with the ram.

42. The method of claim 34 further comprising the step of separating liquid from solids within the first vessel.

43. A method of removing drill cuttings from an oil and gas well drilling platform that uses a drill bit supported with a drill string and a well drilling fluid during a digging of a well bore, comprising the steps of:

a) separating drill cuttings from the well drilling fluid on the drilling platform so that the drilling fluids can be recycled into the well bore during drilling operations;

b) transmitting the cuttings to a cuttings collection area;

c) suctioning the separated drill cuttings with a first suction line having an intake end portion that can be positioned at the cutting collection area;

d) transmitting the drill cuttings via the suction line to a first vessel that has an interior;

e) forming a vacuum within the first vessel interior with a blower that is in fluid communication with the vessel via a second vacuum line;

f) valving the flow of cuttings from the first vessel with a valve;

g) discharging cuttings from the first vessel into a second vessel by opening the valve; and h) separating liquids and solids from at least one of the vacuum lines before said liquids and solids can enter the blower.

* * * * *